US010859050B2

(12) United States Patent
Takamizawa

(10) Patent No.: US 10,859,050 B2
(45) Date of Patent: Dec. 8, 2020

(54) FUEL INJECTION PUMP

(71) Applicant: DENSO CORPORATION, Kariya (JP)

(72) Inventor: Satoru Takamizawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/782,377

(22) Filed: Feb. 5, 2020

(65) Prior Publication Data

US 2020/0284230 A1 Sep. 10, 2020

(30) Foreign Application Priority Data

Mar. 7, 2019 (JP) ..... 2019-041537

(51) Int. Cl.

| | |
|---|---|
| ***F02M 39/02*** | (2006.01) |
| ***F02M 37/06*** | (2006.01) |
| ***F02M 59/10*** | (2006.01) |
| ***F02M 59/46*** | (2006.01) |
| ***F02M 41/12*** | (2006.01) |
| ***F01L 1/14*** | (2006.01) |
| ***F02M 37/04*** | (2006.01) |
| ***F01L 1/16*** | (2006.01) |

(52) U.S. Cl.

CPC ..... *F02M 59/462* (2013.01); *F01L 1/14* (2013.01); *F01L 1/143* (2013.01); *F01L 1/16* (2013.01); *F02M 37/043* (2013.01); *F02M 37/06* (2013.01); *F02M 39/02* (2013.01); *F02M 41/128* (2013.01); *F02M 59/102* (2013.01); *F02M 2700/1335* (2013.01)

(58) Field of Classification Search

CPC ..... F01L 1/143; F01L 1/16; F02M 37/043; F02M 37/06; F02M 37/102; F02M 39/02

USPC ..... 123/90.5, 507, 508

See application file for complete search history.

(56) References Cited

U.S. PATENT DOCUMENTS

| | | | | |
|---|---|---|---|---|
| 4,207,775 | A * | 6/1980 | Lintott | F02M 59/102 74/55 |
| 9,243,521 | B2 * | 1/2016 | Cornett | F01L 1/143 |
| 10,208,725 | B2 * | 2/2019 | Schmidbauer | F16H 21/18 |
| 10,690,016 | B2 * | 6/2020 | Roberts | F01L 1/143 |
| 10,697,413 | B2 * | 6/2020 | Brune | F02M 59/102 |
| 2012/0152187 | A1 * | 6/2012 | Cornett | F01L 1/143 123/90.5 |
| 2013/0104818 | A1 * | 5/2013 | Dorn | F04B 53/14 123/90.5 |

(Continued)

FOREIGN PATENT DOCUMENTS

| | | |
|---|---|---|
| DE | 102015009010 | 1/2017 |
| JP | 3835755 | 10/2006 |
| WO | 2012/079831 | 6/2012 |

*Primary Examiner* — Erick R Solis

(74) *Attorney, Agent, or Firm* — Nixon & Vanderhye P.C.

(57) ABSTRACT

A fuel injection pump includes a cam rotating with a camshaft, a tappet reciprocating in response to rotation of the cam, a cylinder, a plunger, and a thrust washer. The thrust washer is located between the cam and a casing housing the camshaft at both ends of the cam in an axial direction of the cam. The tappet includes a tappet body, a roller, a supporting member, and a contact surface formed at an outer peripheral part of the tappet. The thrust washer includes a rotation restricting part that protrudes toward the tappet over a maximum lift position. The rotation restricting part restricts rotation of the tappet relative to a center axis of the tappet body by being contact with the contact surface.

9 Claims, 8 Drawing Sheets

(56) References Cited

U.S. PATENT DOCUMENTS

2013/0202466 A1 8/2013 Makino
2017/0306810 A1* 10/2017 Nielsen ..... F01L 1/146

* cited by examiner

FUEL INJECTION PUMP

CROSS REFERENCE TO RELATED APPLICATION

This application is based on Japanese Patent Application No. 2019-41537 filed on Mar. 7, 2019, the disclosure of which is incorporated herein by reference in its entirety.

TECHNICAL FIELD

The present disclosure relates to a fuel injection pump.

BACKGROUND

A fuel injection pump pressurizes fuel by rotating a cam and reciprocating a plunger, and supplies the fuel with an injector. The rotation of the cam reciprocates a tappet.

The tappet includes a tappet body supported at a cylinder movable in an axial direction of the tappet body and a roller disposed between the tappet body and the cam. The rotation of the cam causes the roller to rotate and reciprocate, which further reciprocates the plunger and the tappet.

The outer peripheral part of the tappet body is shaped in noncircular, and the inner peripheral part of the cylinder is shaped in noncircular so that the tappet body and the cylinder can be engaged with each other. This restricts the rotation of the tappet.

SUMMARY

A fuel injection pump includes a cam, a tappet, a cylinder, a plunger and a thrust washer.

The cam rotates together with a camshaft. A rotation of the cam reciprocates the tappet. The cylinder supports the tappet movable in an axial direction of the tappet. The plunger reciprocates together with the tappet and injects pressurized fuel. The thrust washer is disposed between the cam and a casing housing the camshaft, at both sides of the cam in an axial direction of the cam.

The tappet has a tappet body, a roller, a supporting member and a contact surface. The contact surface may be defined by a plane surface. The tappet body has a tubular part supported at the cylinder movable in the axial direction of the tappet. The roller is disposed between the tappet body and the cam. The rotation of the cam causes the roller to rotate and reciprocate, which further reciprocates the plunger and the tappet. The supporting member supports the roller rotatable. The contact surface is formed at an outer peripheral part of the tappet.

At least one thrust washer disposed at side of the cam in the axial direction has a rotation restricting part. The rotation restricting part protrudes toward the tappet over a maximum lift position of the cam and gets in contact with the contact surface.

DETAILED DESCRIPTION

Figure 1:
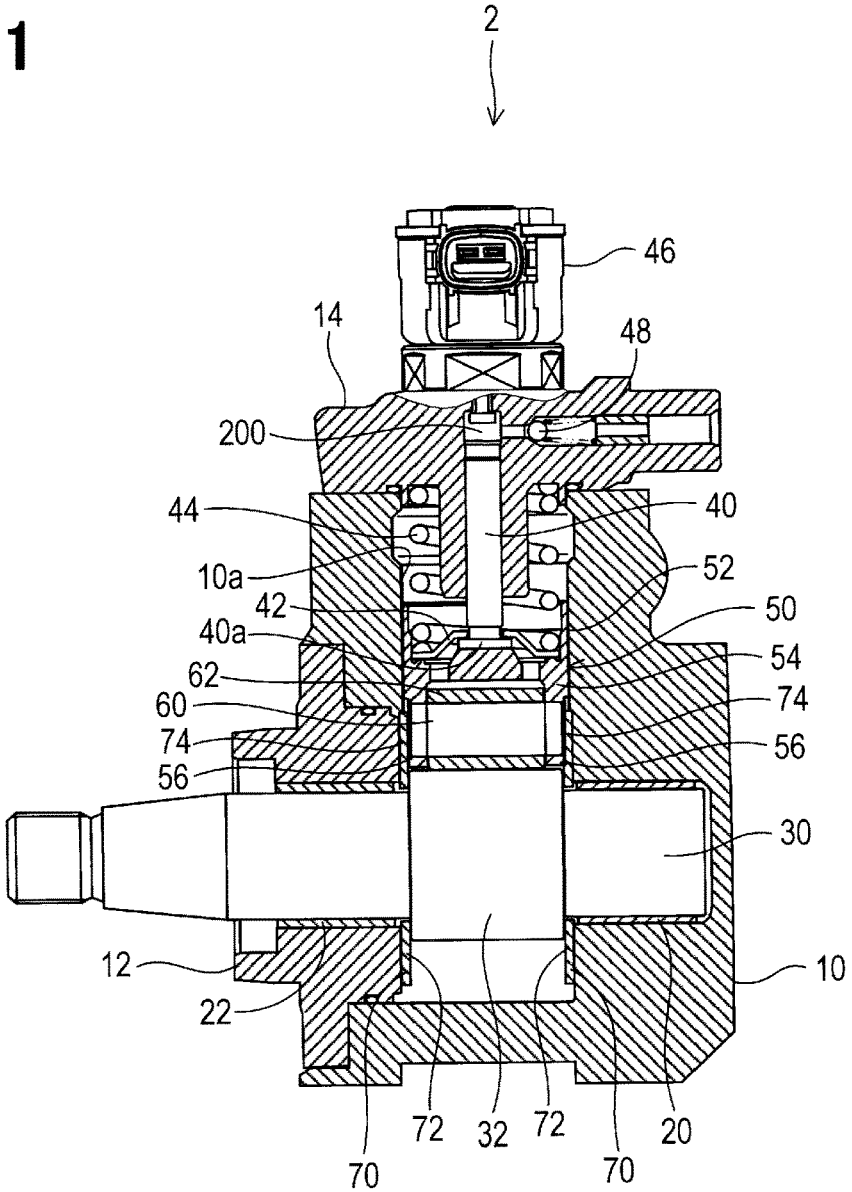
FIG. 1 is a cross section view of a fuel injection pump according to the first embodiment.

To begin with, examples of relevant techniques will be described.

A fuel injection pump pressurizes fuel by rotating a cam and reciprocating a plunger, and supplies the fuel with an injector. The rotation of the cam reciprocates a tappet, which reciprocates the plunger.

The tappet includes a tappet body supported at a cylinder movable in an axial direction of the tappet body and a roller disposed between the tappet body and the cam. The rotation of the cam causes the roller to rotate and reciprocate, which further reciprocates the plunger and the tappet.

When the cam and the tappet are assembled correctly, an outer peripheral part of the cam is in line-contact with an outer peripheral part of the roller. The roller receives an equal force at the line-contact part from the cam.

However, an error of the assembly and abrasion may cause a deviated contact between the outer peripheral part of the cam and the outer peripheral part of the roller. In this case, the roller receives a force from the cam in the deviated position. If the tappet receives torque from the cam relative to a center axis of the tappet body, the tappet may rotate relative to the center axis of the tappet body and is displaced in a circumferential direction. The displacement of the tappet in the circumferential direction may cause a point contact between the roller and the cam, and abrasion of the contact part.

For example, in a comparison example, the outer peripheral part of the tappet body is shaped in noncircular, and the inner peripheral part of the cylinder is shaped in noncircular so that the tappet body and the cylinder can be engaged with each other. This restricts the rotation of the tappet.

However, when the inner peripheral part of the cylinder is processed to have the noncircular surface instead of a continuous circular surface, the cylinder cannot be processed with a commonly used way. This increases a processing cost.

In an aspect of the present disclosure, a fuel injection pump is provided to have a tappet including a tappet body, which has a tubular shape, and is restricted from rotating at a low cost.

A fuel injection pump in accordance with an embodiment in the present disclosure has a cam, a tappet, a cylinder, a plunger and a thrust washer.

The cam rotates together with a camshaft. A rotation of the cam reciprocates the tappet. The cylinder supports the tappet movable in an axial direction of the tappet. The plunger reciprocates together with the tappet and injects pressurized fuel. The thrust washer is disposed between the cam and a casing housing the camshaft, at both sides of the cam in an axial direction of the cam.

The tappet has a tappet body, a roller, a supporting member and a contact surface. The contact surface may be defined by a plane surface. The tappet body has a tubular part supported at the cylinder movable in the axial direction of the tappet. The roller is disposed between the tappet body and the cam. The rotation of the cam causes the roller to rotate and reciprocate, which further reciprocates the plunger and the tappet. The supporting member supports the roller rotatable. The contact surface is formed at an outer peripheral part of the tappet.

At least one thrust washer disposed at side of the cam in the axial direction has a rotation restricting part. The rotation restricting part protrudes toward the tappet over a maximum lift position of the cam and gets in contact with the contact surface. This prevents the rotation of the tappet relative to a center axis of the tappet body.

In this structure, wherever the tappet reciprocates, the rotation restricting part of the thrust washer is in contact with the contact surface of the tappet. When the roller of the tappet receives a force from the cam and the tappet receives a torque relative to the center axis of the tappet body, the tappet is prevented from rotating relative to the center axis of the tappet body and being displaced in the circumferential direction.

The tubular part supports the tappet body at the cylinder movable in the axial direction of the tappet. Thus, the inner peripheral part of the cylinder is formed easily in continuous circular shape as usual. The tappet and the thrust washer are common members used in the fuel injection pump. It is no need to have additional members to restrict the rotation of the tappet. Thus, the rotation of the tappet is restricted at a low cost without additional members.

The plane surface in the present disclosure is not limited to a plane surface in the strict sense. The plane surface may not be a plane surface in the strict sense while the plane surface allows the same effect described above.

Hereinafter, embodiments in this disclosure are explained referring to the figures.

First Embodiment

A fuel injection pump 2 in FIG. 1 supplies pressurized fuel with a common rail (not shown). A pump housing of the fuel injection pump 2 includes a housing 10, a bearing cover 12, and a cylinder head 14.

The housing 10 and the bearing cover 12 bear a camshaft 30 through metal bushings 20 and 22. The cylinder head 14 supports the plunger 40 movable in the axial direction. The metal bushings 20 and 22 are respectively press-fitted to the housing 10 and the bearing cover 12.

Figure 2:
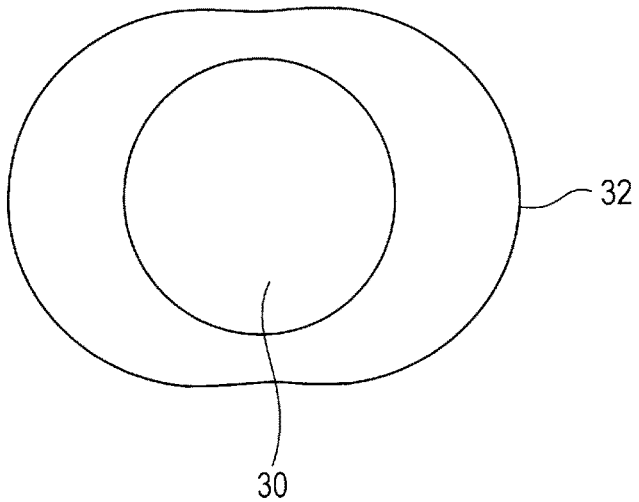
FIG. 2 is a schematic view of a cam of the fuel injection pump.

A compression chamber 200 is formed in the cylinder head 14 at an upper side of the plunger 40 in the axial direction in FIG. 1. The plunger 40 is located between the cam 32 and the compression chamber 200. The compression chamber 200 is supplied with fuel by a feed pump (not shown). As shown in FIG. 2, the camshaft 30 has the cam 32 having a cam contour formed in a shape where two circles partially overlap with each other.

The cylinder head 14 has a regulation valve 46 and an injection valve 48. The regulation valve 46 is an electromagnetic valve. The regulation valve 46 is closed at a predetermined period during a compression process by the plunger 40 and regulates an amount of the fuel injected from the injection valve 48. The injection valve 48 is opened when a fuel pressure in the compression chamber 200 is over the predetermined pressure during the compression process, and injects the fuel in the compression chamber 200 from the fuel injection pump 2.

A plunger head 40*a* of the plunger 40 is attached to the tappet 50 by a lower seat 42. The tappet 50 is applied with a load by a spring 44, and applies a load to the cam 32.

Figure 3:
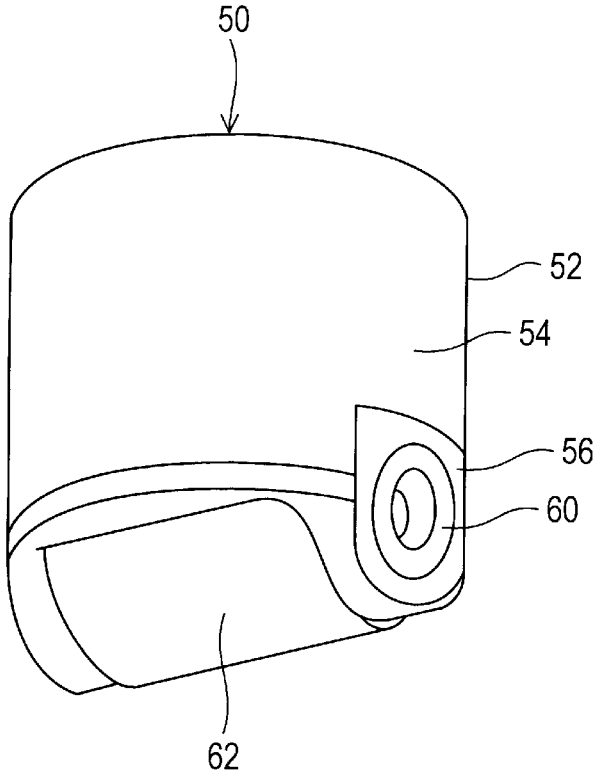
FIG. 3 is a perspective view of a tappet of the fuel injection pump.

As shown in FIGS. 1 and 3, the tappet 50 includes a tappet body 52, a pin 60 supported at both sides in an axial direction by the tappet body 52, and a roller 62. The tappet body 52 has a tubular part 54 and a plane surface 56 in contact with a thrust washer 70 described later. The tubular part 54 is supported movable in the axial direction in a cylinder 10*a* of the housing 10. An outer peripheral part of the tubular part 54 and an outer peripheral part of the plane surface 56 are different surfaces.

The pin 60 is supported rotatable at the both sides in the axial direction by the tappet body 52, or press-fitted to and fixed at the tappet body 52. The roller 62 has a tubular shape. The pin 60 is engaged with an inner peripheral part of the roller 62 and supports the roller 62 rotatable. The both ends of the pin 60 in the axial direction are recessed from the plane surface 56 inward in a radial direction of the tappet 50.

Figure 4:
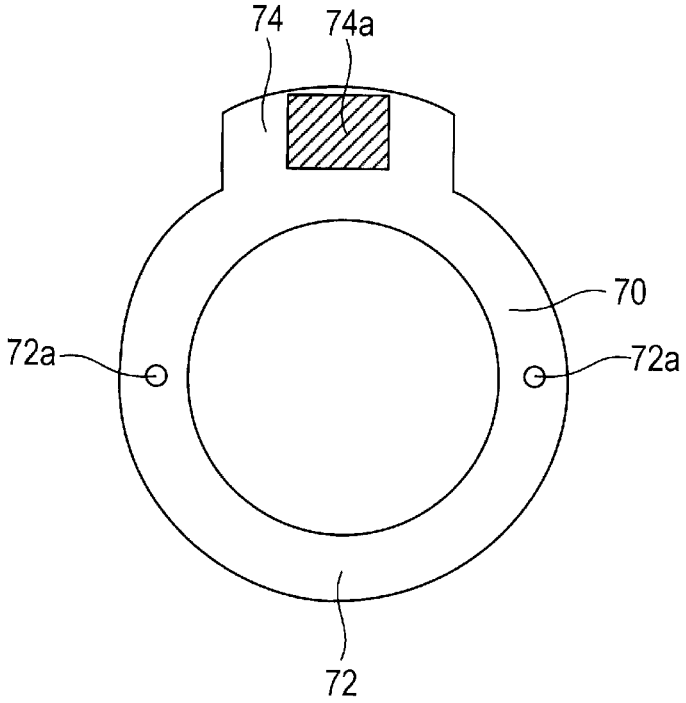
FIG. 4 is a schematic view of a thrust washer of the fuel injection pump.

The thrust washer 70 has a plate shape. The thrust washer 70 is located at between the cam 32 and the housing 10 at the both ends of the cam 32 in an axial direction. As shown in FIG. 4, the thrust washer 70 includes an annular part 72 and a rotation restricting part 74.

The annular part 72 has through holes 72*a* formed at both sides of the cam 32 in a radial direction. A pin is inserted in the through hole 72*a* of the thrust washer 70 and press-fitted to the housing 10, so that the thrust washer 70 is fixed to the housing 10. The thrust washer 70 restricts the rotation of the camshaft 30 relative to a rotation axis 30*a* (shown in FIG. 6) of the camshaft 30. The thrust washer 70 may be fixed to the housing 10 by welding instead of using the pin.

Figure 5:
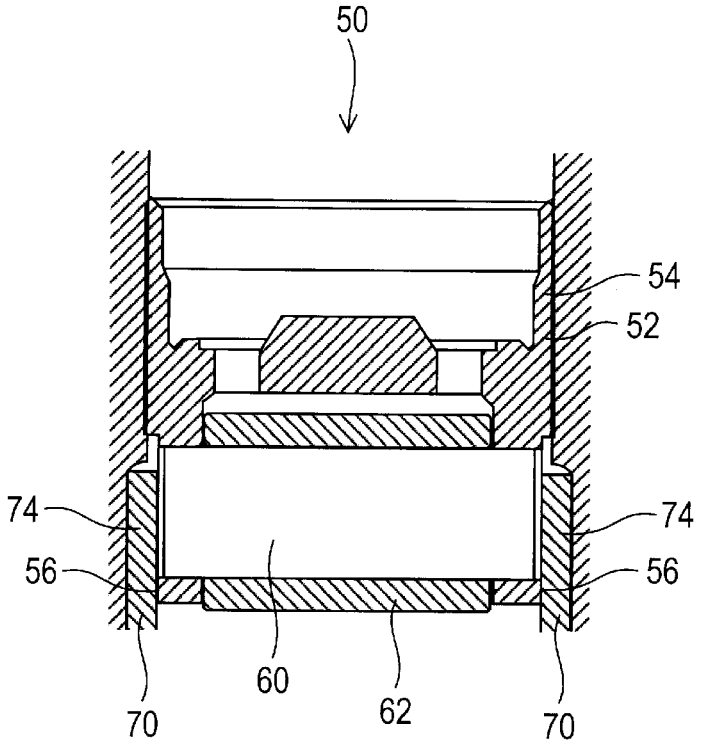
FIG. 5 is a cross section view illustrating a contact state between the thrust washer and the tappet.

The annular part 72 is engaged with an outer peripheral part of the camshaft 30 and applied with a thrust load from the cam 32. As shown in FIGS. 4 and 5, the rotation restricting part 74 protrudes from a part of the annular part 72 in a circumferential direction toward the plane surface 56 of the tappet body 52 in a radial direction of the thrust washer 70. The rotation restricting part 74 and the annular part 72 are on the same plane. The rotation restricting part 74 is in contact with the plane surface 56 of the tappet body 52 at a hatched part 74*a* in FIG. 4.

Figure 6:
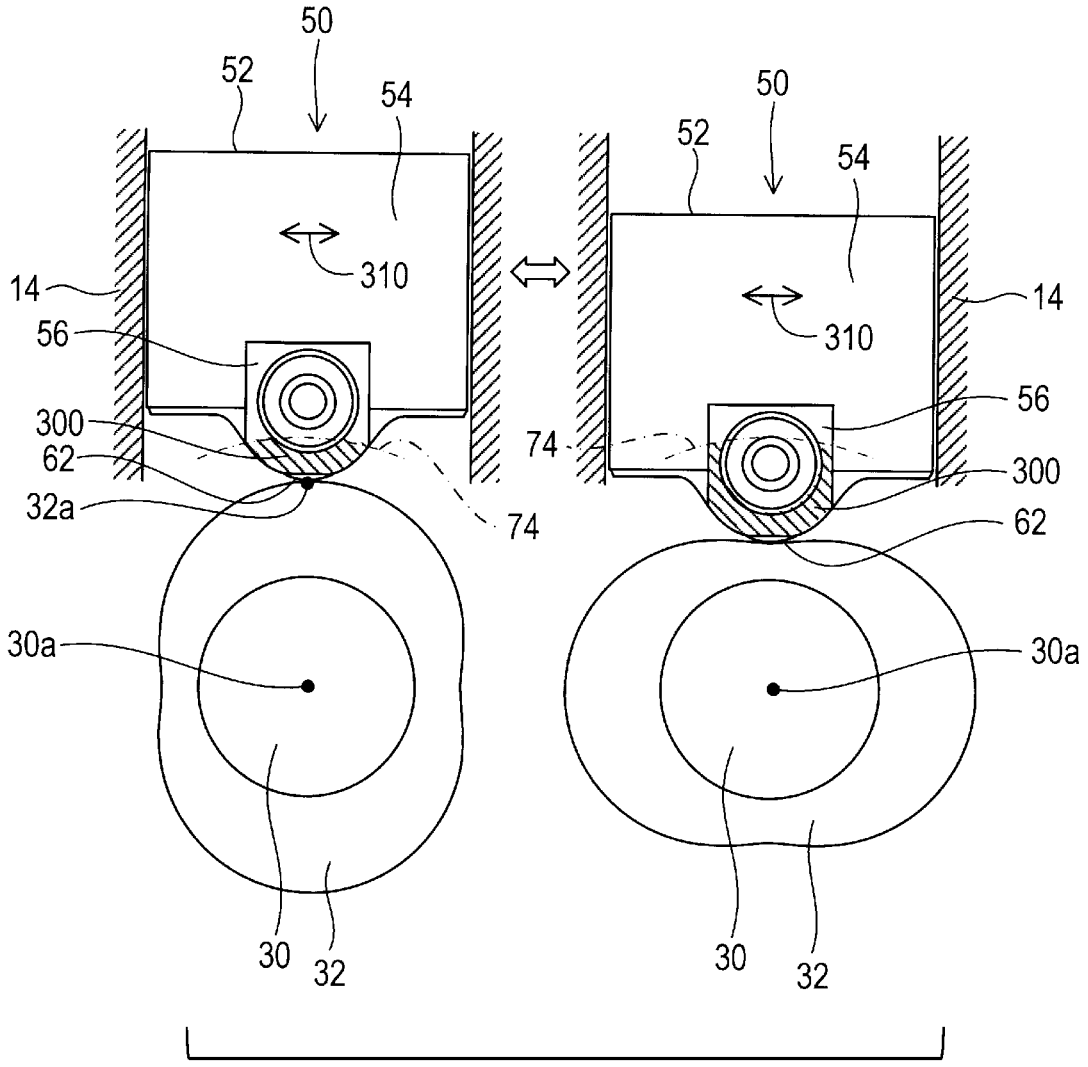
FIG. 6 is a schematic view illustrating a change of a contact position between the thrust washer and the tappet in response to rotation of the cam.

As shown in FIG. 6, the cam 32 rotates and then the roller 62 rotates by being contact with an outer peripheral part of the cam 32, which reciprocates the tappet 50. The rotation restricting part 74 of the thrust washer 70 protrudes toward the tappet 50 over a maximum lift position 32*a* of the cam 32. The maximum lift position 32*a* of the cam 32 is a position where the cam 32 gets in contact with the roller 62 when the tappet 50 is located at the highest position toward the upper side in the cylinder head 14, or a maximum lift position, shown in the left side in FIG. 6.

When the tappet 50 is located at the maximum lift position 32*a* shown in the left side in FIG. 6, the rotation restricting part 74 of the thrust washer 70 is still in contact with the plane surface 56 of the tappet body 52 at the hatched part 300 in FIG. 6. Wherever the tappet 50 reciprocates, the rotation restricting part 74 of the thrust washer 70 is in contact with the plane surface 56 of the tappet 50.

Wherever the tappet 50 reciprocates, the rotation restricting part 74 of the thrust washer 70 is in contact with the plane surface 56 of the tappet 50. When the tappet 50 receives a torque in a rotation direction relative to a center axis of the tappet body 52 shown in an arrow 310 in FIG. 6, the tappet 50 is prevented from rotating.

The tappet body 52 having the tubular shape is supported at the cylinder 10*a* movable in the axial direction. The cylinder 10*a* has an inner peripheral part that is continuously curved with a fixed diameter. Thus, the cylinder 10*a* is processed easily at a low cost.

The tappet 50 and the thrust washer 70 are common members used in the fuel injection pump 2. The restriction of the rotation of the tappet 50 is achieved at a low cost without additional members.

In the first embodiment, the housing 10 and the bearing cover 12 correspond to the casing, the cylinder 10*a* corresponds to the cylinder, a pin 60 corresponds to the supporting member, and a plane surface 56 corresponds to the contact surface.

Second Embodiment

The second embodiment is a modification of the first embodiment. The same symbol with the first embodiment indicates the same structure and is referred in the preceding explanations.

Figure 7:
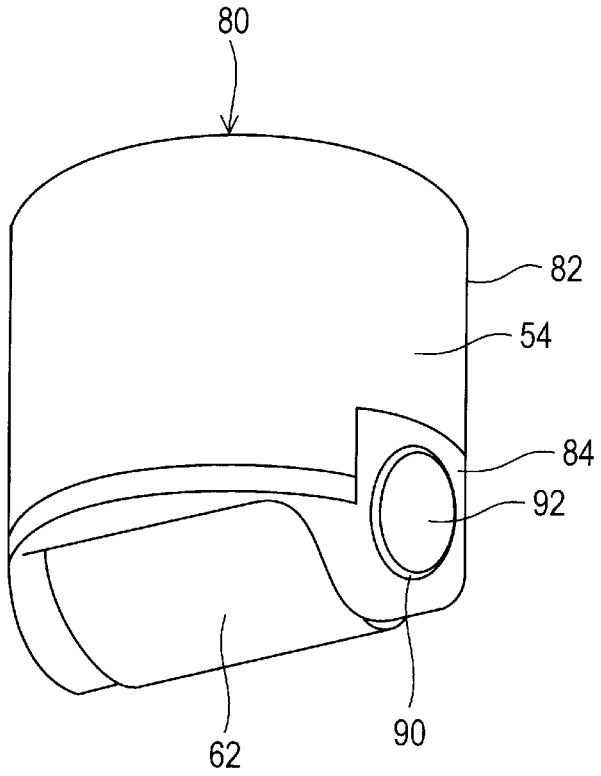
FIG. 7 is a perspective view of a tappet according to the second embodiment.

In the first embodiment described above, the plane surface 56 of the tappet body 52 is in surface-contact with the rotation restricting part 74 of the thrust washer 70 to restrict the rotation of the tappet 50. In the second embodiment, as shown in FIG. 7, both ends of a pin 90 in the axial direction passes through a tappet body 82 of a tappet 80 and protrudes outward over a plain surface 84 in the radial direction of the tappet body 82. The pin 90 is engaged with the inner peripheral part of the roller 62. The both ends of the pin 90 are plane surfaces 92 of the tappet 80 and get in surface-contact with the rotation restricting part 74 of the thrust washer 70, which restricts the rotation of the tappet 80.

The plain surface 84 of the tappet body 82 is located inward in the radial direction compared to the plane surface 56 of the tappet body 52 in the first embodiment. The length of the pin 90 in the axial direction is longer than the length of the pin 60 in the axial direction in the first embodiment.

According to the second embodiment, the same effects with the first embodiment are obtained. The tappet 50 corresponds to the tappet 80, the tappet body 52 corresponds to the tappet body 82, and the plane surface 56 corresponds to the plane surface 92.

In the second embodiment, the plane surface 92 of the pin 90 corresponds to the contact surface.

Third Embodiment

The third embodiment is a modification of the first embodiment. The same symbol with the first embodiment indicates the same structure and is referred in the preceding explanations.

Figure 8:
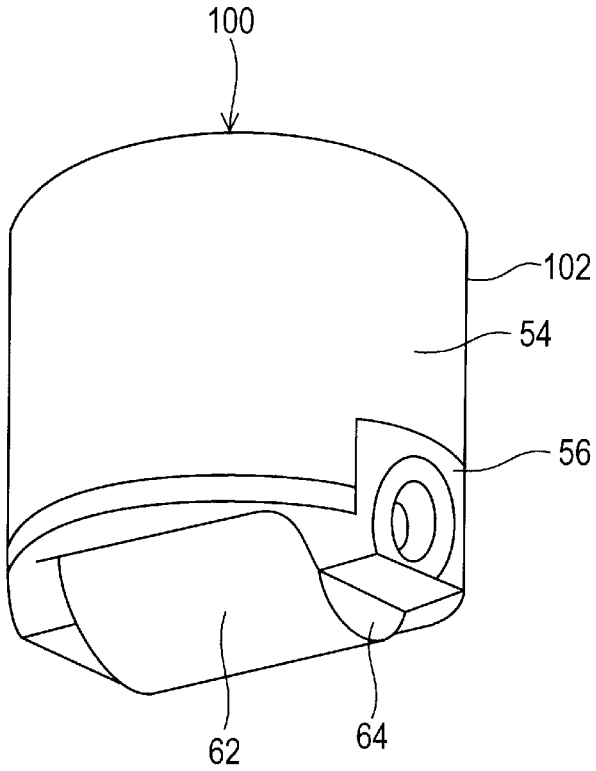
FIG. 8 is a perspective view of a tappet according to the third embodiment.

According to the first embodiment described above, the plane surface 56 of the tappet body 52 is in surface-contact with the rotation restricting part 74 of the thrust washer 70 to restrict the rotation of the tappet 50. In a tappet 100 in the third embodiment shown in FIG. 8, the plane surface 56 of a tappet body 102 is cut on the side adjacent to the cam 32 so that the both ends of the roller 62 in the axial direction is exposed as a plane surface 64 of the tappet 100.

The plane surface 64 is in surface-contact with the rotation restricting part 74 of the thrust washer 70 to restrict the rotation of the tappet 100. The thickness of the rotation restricting part 74 is thicker than that of the annular part 72 so that the rotation restricting part 74 is in surface-contact with the plane surface 64 of the roller 62.

According to the third embodiment described above, the same effects with the first embodiment are obtained. The tappet 50 corresponds to the tappet 100, the tappet body 52 corresponds to the tappet body 102, and the plane surface 56 corresponds to the plane surface 64.

In the third embodiment described above, the plane surface 64 corresponds to the contact surface.

Fourth Embodiment

The fourth embodiment is a modification of the first embodiment. The same symbol with the first embodiment indicates the same structure and is refereed in the preceding explanations.

Figure 9:
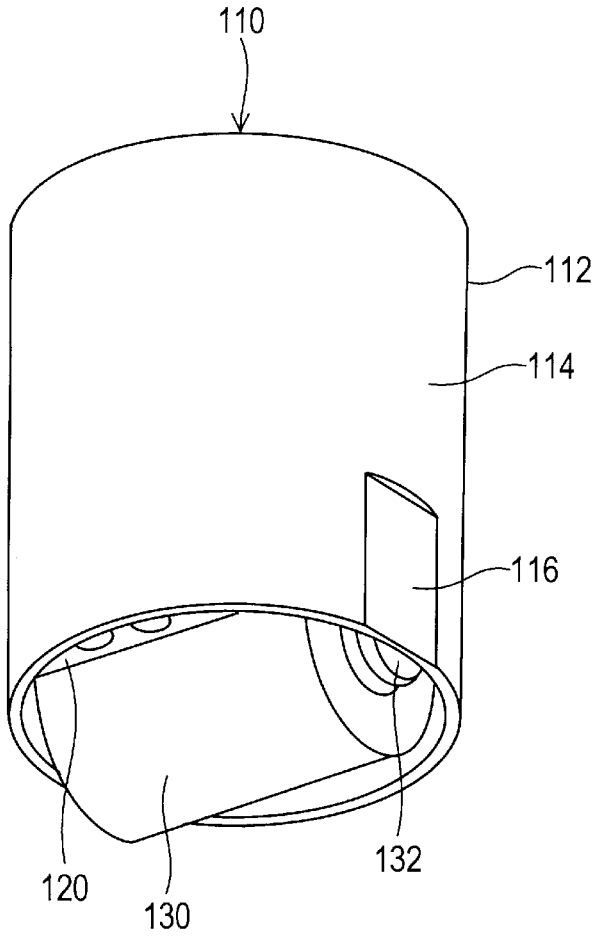
FIG. 9 is a perspective view of a tappet according to the fourth embodiment.
Figure 10:
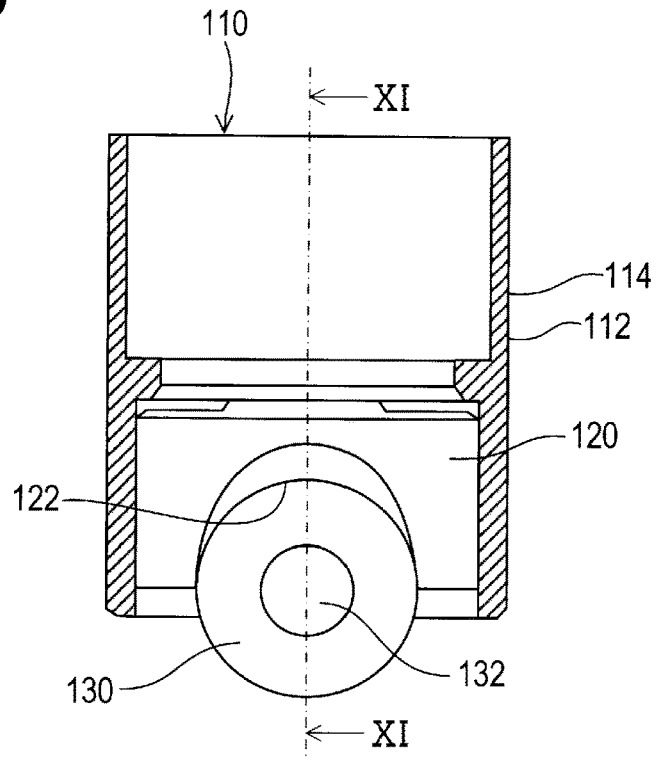
FIG. 10 is a cross section view of the tappet in FIG. 9 taken along a plane orthogonal to the rotation axis of the roller.
Figure 11:
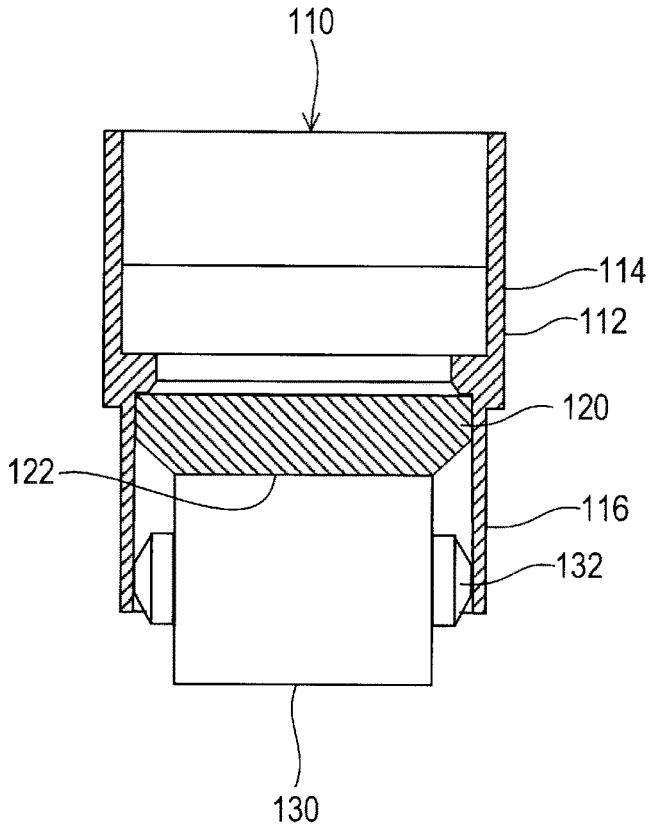
FIG. 11 is a cross section view taken along the line XI-XI in FIG. 10.

In the first embodiment described above, the outer peripheral part of the pin 60 is engaged with the roller 62 and supports the roller 62 rotatable. In the fourth embodiment shown in FIGS. 9 to 11, a shoe 120 is disposed at the inner peripheral part of a tappet body 112 of a tappet 110. The shoe houses a roller 130 and supports the roller 130 rotatable. The shoe 120 may be press-fitted to the tappet body 112.

The shoe 120 has an inner peripheral surface 122. A cross section of the inner peripheral surface 122 in the axial direction is shaped in arc. The inner peripheral surface 122 is engaged with an outer peripheral part of the roller 130 opposite from the cam 32 through the roller 130. A substantially half of the roller 130 is housed in the shoe 120. The roller 130 has a shaft part 132 at the both ends in the axial direction. The shaft part 132 is in contact with the inner peripheral part of the tappet body 112, which prevents the roller 130 from moving in the axial direction.

A plane surface 116 is formed on a surface of the tappet body 112 other than an outer circumferential part of a tubular part 114 of the tappet body 112. The plane surface 116 is in surface-contact with the rotation restricting part 74 of the thrust washer 70, which restricts the rotation of the tappet 110.

According to the fourth embodiment described above, the same effects with the first embodiments are obtained. The tappet 50 corresponds to the tappet 110, the tappet body 52 corresponds to the tappet body 112, and the plane surface 56 corresponds to the plane surface 116.

In the fourth embodiment, the shoe 120 corresponds to the supporting member.

Fifth Embodiment

The fifth embodiment is a modification of the first embodiment. The same symbol with the first embodiment indicates the same structure and is refereed in the preceding explanations.

In the first embodiment described above, the rotation restricting part 74 of the thrust washer 70 protrudes outward in the radial direction from a part of the annular part 72 in the circumferential direction. In other words, the rotation restricting part 74 protrudes toward the plane surface 56 of the tappet body 52 in the radial direction.

Figure 12:
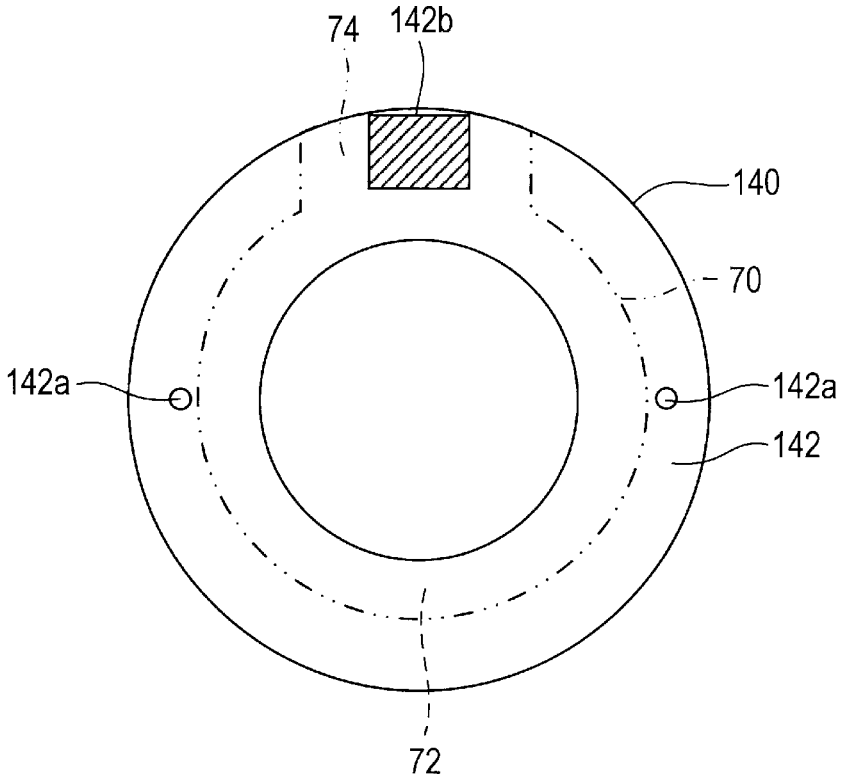
FIG. 12 is a schematic view of a thrust washer according to the fifth embodiment.

In the fifth embodiment shown in FIG. 12, a thrust washer 140 is configured only with an annular part 142. The annular part 142 does not have a projection protruding outward in the radial direction from a part of the annular part 142 in the circumferential direction.

The thrust washer 140 has a plate shape, and through holes 142*a* pass through the plate shape on both sides of the annular part 142 in the radial direction. A pin is inserted in the through hole 142*a* of the thrust washer 140 and press-fitted to the housing 10 to fix the thrust washer 140 to the housing 10. The thrust washer 140 restricts the rotation of the camshaft 30 relative to the rotation axis 30*a*. The thrust washer 140 may be fixed to the housing 10 by welding instead of using the pin.

An outer diameter of the annular part 142 is larger compared to an outer diameter of the annular part 72 in the first embodiment. The outer peripheral end of the annular part 142 is located at a substantially same position with an outer peripheral end of the rotation restricting part 74 in the first embodiment. The annular part 142 protrudes toward the tappet 50 over the maximum lift position 32*a* of the cam 32. The annular part 142 is in contact with the plane surface 56 of the tappet body 52 at a hatched part 142*b* in FIG. 12. This restricts the rotation of the tappet 50 relative to the center axis of the tappet body 52.

According to the fifth embodiment, the same effects with the first embodiment are obtained. The thrust washer 70 corresponds to the thrust washer 140 and the rotation restricting part 74 corresponds to the hatched part 142*b*.

The thrust washer 140 is configured with the annular part 142, which makes the processing of the thrust washer 140 easy. In the fifth embodiment, the hatched part 142*b* of the annular part 142 corresponds to the rotation restricting part.

Sixth Embodiment

The sixth embodiment is a modification of the first embodiment. The same symbol with the first embodiment indicates the same structure and is refereed in the preceding explanations.

Figure 13:
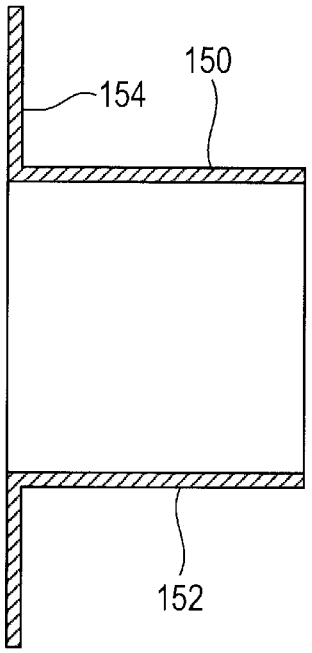
FIG. 13 is a cross section view illustrating a thrust washer and a bushing according to the sixth embodiment.

In the first embodiment described above, the thrust washer 70 and the metal bushings 20, 22 are formed independently. In the sixth embodiment shown in FIG. 13, a metal bushing part 152 and a thrust washer part 154 are integrally formed to get a structure body 150. The metal bushing part 152 corresponds to the metal bushings 20, 22 in the first embodiment, and the thrust washer part 154 corresponds to the thrust washer 70 in the first embodiment.

The structure body 150 may be integrally formed with the metal bushing part 152 and the thrust washer part 154, or may be formed by welding the metal bushing part 152 and the thrust washer part 154, which are formed independently.

In the sixth embodiment described above, the same effects with the first embodiment are obtained. The thrust washer 70 corresponds to the thrust washer part 154.

The metal bushing part 152 and the thrust washer part 154 are integrally formed to the structure body 150, so that the assembly procedure of the structure body 150 is reduced compared to a case where the metal bushing part 152 and the thrust washer part 154 are assembled independently.

In the sixth embodiment, the thrust washer part 154 corresponds to the thrust washer.

Other Embodiment

Embodiments in the present disclosure are explained, but this disclosure is not limited to the above-mentioned embodiments and achieved in various modifications.

In the above-mentioned embodiments, the outer peripheral part of the cam 32 is in contact with the roller 62, 130. The roller 62, 130 may be in contact with a cam ring engaged with an outer peripheral part of an eccentric circular cam. In this case, a plurality of plungers may be disposed at an outer peripheral part of the cam ring in the fuel injection pump.

In the above-mentioned embodiments, each of the two thrust washers disposed at the both sides of the cam 32 in the axial direction has a rotation restricting part that restricts the rotation of the tappet by being contact with the plane surface of the tappet. Only one of the two thrust washers disposed at the both sides of the cam 32 in the axial direction may have the rotation restricting part that restricts the rotation of the tappet by being contact with the contact surface of the tappet.

A plurality of functions that one element in the above-mentioned embodiments has may be achieved by a plurality of elements, and one function that one element has may be achieved by a plurality of elements. A plurality of functions that a plurality of elements has may be achieved by one element, and one function that a plurality of elements has may be achieved by one element. A part of the structure in the above-mentioned embodiments may be omitted. At least one part of the structure in the above-mentioned embodiment may be added or replaced to the structure in other embodiments.

The present disclosure may be achieved in a system having the fuel injection pump, other than the fuel injection pump mentioned above.

What is claimed is:

1. A fuel injection pump comprising:

a cam configured to rotate together with a camshaft;

a tappet configured to reciprocate in response to rotation of the cam;

a cylinder supporting the tappet movable in an axial direction of the cylinder;

a plunger reciprocating together with the tappet to inject pressurized fuel; and a thrust washer located between the cam and a casing housing the camshaft at both ends of the cam in an axial direction of the cam, wherein the tappet includes:

a tappet body having a tubular part supported movable in the axial direction of the tappet body at the cylinder;

a roller disposed between the tappet body and the cam, the roller rotating and reciprocating in response to rotation of the cam to move the plunger and the tappet;

a supporting member supporting the roller rotatable; and a contact surface formed at an outer peripheral part of the tappet, the thrust washer includes a rotation restricting part that protrudes toward the tappet over a maximum lift position of the cam, and the rotation restricting part restricts rotation of the tappet relative to a center axis of the tappet body by being in contact with the contact surface of the tappet.

2. The fuel injection pump according to claim 1, wherein the contact surface has a plane surface formed at an outer peripheral part of the tappet body that is different from an outer peripheral part of the tubular part.

3. The fuel injection pump according to claim 2, wherein the roller has a tubular shape, and the supporting member is engaged with an inner peripheral part of the roller and supported by the tappet body.

4. The fuel injection pump according to claim 1, wherein the roller has a tubular shape, the supporting member is engaged with an inner peripheral part of the roller and supported by the tappet body, at least one end of the supporting member in the axial direction of the supporting member passes through the tappet body and protrudes outward from the outer peripheral part of the tappet body, and an end surface of the at least one end of the supporting member forms the contact surface.

5. The fuel injection pump according to claim 1, wherein the supporting member is disposed in the tappet body, the supporting member includes an inner peripheral surface having an arc-shaped cross section, and the inner peripheral surface is engaged with an outer peripheral part of the roller which is opposite to and further from the cam.

6. The fuel injection pump according to claim 1, wherein the rotation restricting part is a plane surface in contact with the contact surface of the tappet, and the plane surface is flush with a plane surface of the thrust washer that receives a thrust load from the cam.

7. The fuel injection pump according to claim 1, wherein the thrust washer is fixed to the casing housing the camshaft and restricts rotation of the camshaft relative to a rotation axis of the camshaft.

8. The fuel injection pump according to claim 1, wherein the rotation restricting part of the thrust washer protrudes toward the contact surface of the tappet from a part of the thrust washer in a circumferential direction.

9. The fuel injection pump according to claim 1, wherein the thrust washer is integrally formed with a bushing supporting the rotation of the camshaft.

* * * * *